US010139200B2

(12) United States Patent
Derode

(10) Patent No.: US 10,139,200 B2
(45) Date of Patent: Nov. 27, 2018

(54) CONTAINMENT DEVICE COMPRISING A DRY CURTAIN

(71) Applicant: AIRBUS SAFRAN LAUNCHERS SAS, Issy-les-Moulineaux (FR)

(72) Inventor: Thibault Derode, Bordeaux (FR)

(73) Assignee: AIRBUS SAFRAN LAUNCHERS SAS (FR)

( * ) Notice: Subject to any disclaimer, the term of this patent is extended or adjusted under 35 U.S.C. 154(b) by 0 days.

(21) Appl. No.: 15/319,553

(22) PCT Filed: Jun. 17, 2015

(86) PCT No.: PCT/EP2015/063544
§ 371 (c)(1),
(2) Date: Dec. 16, 2016

(87) PCT Pub. No.: WO2015/193347
PCT Pub. Date: Dec. 23, 2015

(65) Prior Publication Data

US 2017/0153088 A1 Jun. 1, 2017

(30) Foreign Application Priority Data

Jun. 17, 2014 (FR) ..... 14 55550

(51) Int. Cl.

| | |
|---|---|
| ***F41H 5/007*** | (2006.01) |
| ***E06B 9/06*** | (2006.01) |
| ***E06B 9/13*** | (2006.01) |
| ***E06B 9/17*** | (2006.01) |
| ***E04B 1/92*** | (2006.01) |

(Continued)

(52) U.S. Cl.
CPC ..... *F41H 5/007* (2013.01); *E04B 1/92* (2013.01); *E06B 9/0692* (2013.01); *E06B 9/13* (2013.01);

(Continued)

(58) Field of Classification Search
CPC ..... F47H 5/007; G21F 7/005; E06B 9/17023; E06B 9/84; E06B 9/1703; E06B 2009/17069; F41H 5/24; F41H 5/007; E04B 1/947; G21Y 2002/501; A47H 2/02
See application file for complete search history.

(56) References Cited

U.S. PATENT DOCUMENTS 2,501,133 A * 3/1950 Levy ..... A47H 2/00 160/38
2,565,588 A * 8/1951 Bruno ..... A47H 2/02 160/38

(Continued)

FOREIGN PATENT DOCUMENTS

DE 10 2014 001 636 A1 * 8/2015
FR 2684008 A1 * 5/1993

(Continued)

OTHER PUBLICATIONS

International Search Report, International Application No. PCT/EP2015/063544 dated Oct. 6, 2015.

*Primary Examiner* — Catherine A Kelly
(74) *Attorney, Agent, or Firm* — Perman & Green, LLP

(57) ABSTRACT

A containment device including a curtain that can be deployed from a first wound or folded position into a second unwound position, and a case for storing the curtain in the first position. The case is formed by a plurality of adjacent modules, the plurality of modules including active modules that are equipped with means for retaining and releasing the curtain and passive modules that are not equipped with means for retaining and releasing the curtain.

14 Claims, 5 Drawing Sheets

(51) Int. Cl.

| | |
|---|---|
| ***F41H 5/24*** | (2006.01) |
| ***G21F 3/00*** | (2006.01) |
| ***G21F 7/005*** | (2006.01) |

(52) U.S. Cl.

CPC ..... *E06B 9/1703* (2013.01); *E06B 9/17007* (2013.01); *E06B 9/17023* (2013.01); *E06B 9/17061* (2013.01); *F41H 5/24* (2013.01); *G21F 3/00* (2013.01); *G21F 7/005* (2013.01); *E04B 2001/925* (2013.01); *E06B 2009/17069* (2013.01); *G21Y 2002/202* (2013.01); *G21Y 2002/501* (2013.01); *G21Y 2004/30* (2013.01)

(56) References Cited

U.S. PATENT DOCUMENTS

| | | | | |
|---|---|---|---|---|
| 3,521,692 | A * | 7/1970 | Alley | E05B 9/262 160/1 |
| 3,687,185 | A | 8/1972 | Singer | |
| 4,077,474 | A * | 3/1978 | Hattori | A62C 2/10 160/1 |
| 4,791,994 | A * | 12/1988 | Ho | A62C 2/10 160/1 |
| 6,031,462 | A | 2/2000 | Van Den Schoor et al. | |
| 2006/0027335 | A1 * | 2/2006 | Nien | E05B 9/322 160/39 |
| 2012/0325411 | A1 * | 12/2012 | Petri | A47H 2/02 160/21 |
| 2015/0361714 | A1 * | 12/2015 | Derode | E06B 5/125 160/3 |
| 2017/0130521 | A1 * | 5/2017 | Derode | E06B 5/125 |
| 2017/0153088 | A1 * | 6/2017 | Derode | F41H 5/007 |

FOREIGN PATENT DOCUMENTS

| | | |
|---|---|---|
| FR | 2999637 | 6/2014 |
| GB | 2264331 | 8/1993 |

* cited by examiner

CONTAINMENT DEVICE COMPRISING A DRY CURTAIN

CROSS REFERENCE TO RELATED APPLICATIONS

This application is the National Stage of International Application No. PCT/EP2015/063544, having an International Filing Date of 17 Jun. 2015, which designates the United States of America, and which International Application was published under PCT Article 21(2) as WO Publication No. 2015/193347 A1, and which claims priority from and the benefit of French Application No. 1455550, filed 17 Jun. 2014, the disclosures of which are incorporated herein by reference in their entireties.

BACKGROUND

1. Field

The disclosed embodiment relates to the field of the containment of methods that involve high risks of emission of particularly toxic or radioactive substances.

It relates more generally to the safeguarding of infrastructures involving high risk processes where risks of explosion and blast (pyrotechnic, chemical, etc.) and risks of the emission of toxic chemical substances or of radioactive substances are present.

Its objective is to afford collective protection in an industrial safety and civilian safety environment.

2. Brief Description of Related Developments

When a method combines high risks of explosion and blast with high risks of emissions of particularly toxic or radioactive substances, it is desirable to be able to contain the method within an infrastructure such as a building that opposes the spread of these substances.

Depending on the amount of energy involved in the event of an explosion, it may be elusory or, at the very least, prohibitive, to create a building that is totally sealed in the event of a blast.

In the case of a building that is not sealed, it is possible to limit the amount of effluent emitted by defining a discharge surface that will allow the building to maintain its integrity, this discharge surface operating as a relief valve.

In the context of the presently disclosed embodiment, we are assuming a configuration in which the building is resistant to a blast and does not collapse.

Even if a portion of the toxic or radioactive substances is emitted at the time of the explosion through the discharge surface of the building, immediate recontainment of the building at the discharge surface is highly beneficial and makes it possible to greatly limit, or even eliminate, gaseous or particulate emissions after the blast and thus limit the harmful effect on the personnel and surrounding populations.

The containment solutions for collective protection in the field of industrial risks are at various stages of development.

In the event of a fire, containment by a curtain of water triggered upon detection of a fire and fire break partitioning are nowadays widely used and numerous devices created according to this principle are available.

The creation of containment zones for gaseous or particulate emissions is well known for installations that do not carry a risk of explosion.

For completely uncontained zones, abatement technologies employing curtains of water are widely used.

The disadvantages with containment using a curtain of water are that its effectiveness decreases over time and that its autonomy is limited or requires a continuous supply of water.

There is also a recontainment technology using an automatic or controlled moving door, but the main problem is that of guaranteeing that the door remains functional after the effects of the blast and notably the shockwave, the impacts of fragments or the deformation of the building.

Furthermore, these doors take a not-insignificant time to operate.

A dry curtain device is also described in French publication number FR2999637 A1 published on 20 Jun. 2014 in the name of the applicant company and incorporated here by reference in its entirety.

SUMMARY

The presently disclosed embodiment seeks to provide a recontainment solution that has a very short response time, is highly effective and well sealed, is highly reliable and is resistant to the attacks associated with the initial explosion: shockwave, fragments, deformation of the building.

In order to achieve this, the disclosed embodiment proposes a containment device comprising a curtain that can be deployed from a wound or folded first position into an unwound second position, comprising a storage box for storing the curtain in the first position, for which the box is made up of a plurality of juxtaposed modules, the plurality of modules comprising active modules which are provided with curtain retaining and release means and passive modules which do not have said curtain retaining and release means the curtain.

Advantageously, the curtain retaining and release means are produced by actuating cylinders.

More particularly, the actuating cylinders comprise a finger, for example the rod of the actuating cylinder, able to move between a deployed curtain-retaining position and a retracted curtain-release position.

According to one particular aspect, the finger in the deployed position is inserted into first eyelets of curtain retaining straps, the finger in the retracted position releasing said straps so as to allow the curtain to fall.

The device advantageously comprises a curtain retaining web connected to the straps and on which the curtain rests in the wound position. The web is, for example, made from the same material as the curtain in order to ensure its longevity.

The ends of the straps that accept the fingers of the actuating cylinders are advantageously provided with rigid plates in which the first eyelets are made.

The modules advantageously comprise a rear face for attaching the modules to a wall, which face is provided with holes for accepting rods projecting from the wall, said holes being sized to allow the modules some clearance with respect to the diameter of the rods.

The fixing of the modules to the rods preferably involves shims such as blocks or washers.

For preference, at least one of said shims, which is arranged in the lower part of the module in a space accommodating the curtain, is rounded so as to be unlikely to damage the curtain.

The device advantageously comprises bars for supporting a top end of the curtain, said bars being fixed to the rear face of the modules by fixing means which are provided with a range of position adjustment in the vertical direction of deployment of the curtain.

The modules advantageously comprise an upper wall, a front wall and lateral walls.

The lateral walls preferably comprising rounded cutouts provided with curtain centering plates which press on or cover the external diameter of the rolled curtain.

The active modules advantageously comprise at least one means of disabling the curtain release means.

According to one advantageous aspect, the disabling means is advantageously a handle equipped with a locking bolt which, in a device disabling position, engages in second eyelets of the straps retaining the curtain whatever the position of the fingers of the actuating cylinders.

The disabling handle is advantageously received in a tube provided with grooves defining three positions of the handle, a curtain installation position, a curtain immobilizing position and a curtain release position, the handle being able to signal these positions to the operator.

BRIEF DESCRIPTION OF THE DRAWINGS

Other features and advantages of the disclosed embodiment will become apparent from reading the following description of some nonlimiting examples which is accompanied by the drawings which depict.

DETAILED DESCRIPTION

Figure 1:
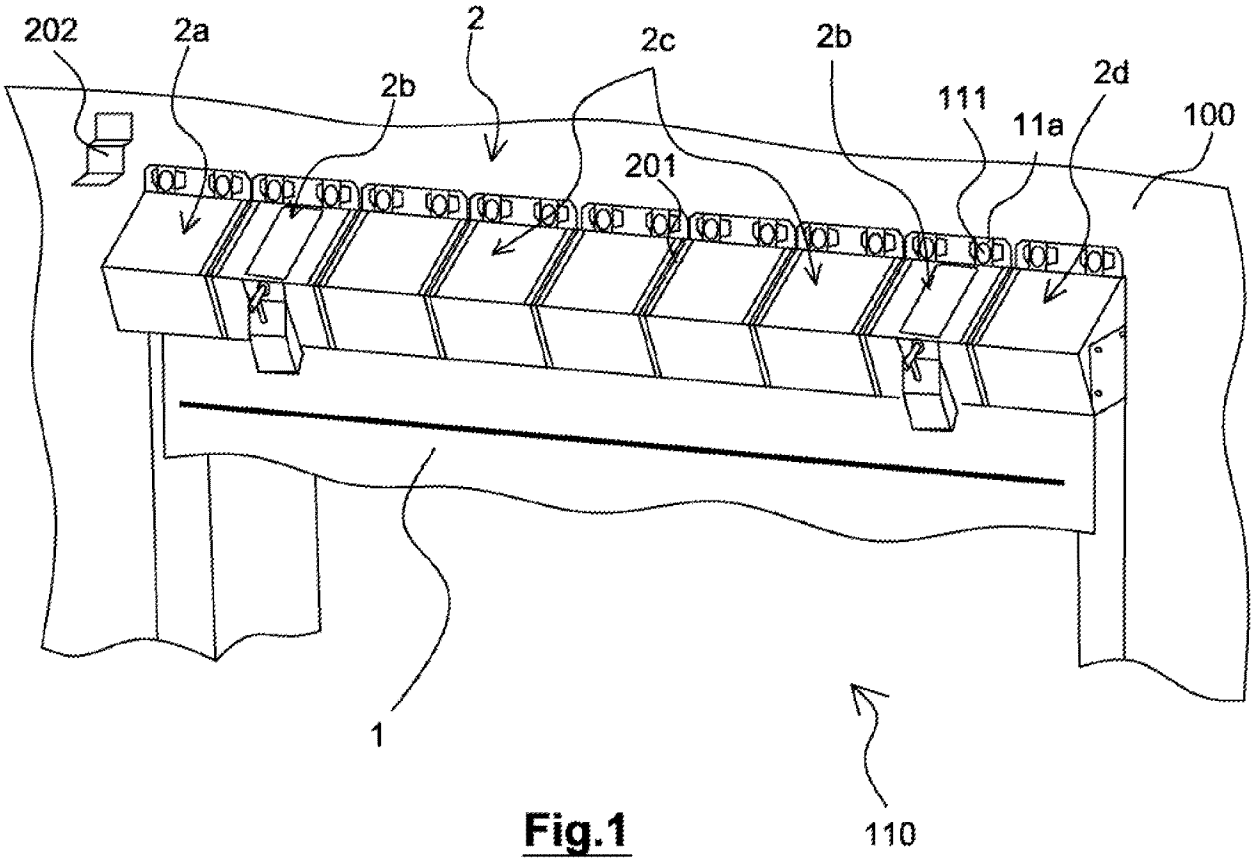
FIG. 1 is a view of a curtain box according to the disclosed embodiment, seen in perspective.

FIG. 1 describes a device produced according to the disclosed embodiment and comprising a dry curtain 1 arranged in such a way as to be able to contain or recontain a discharge zone, for example an opening 110 in a wall 100, in response to an explosion. The device of the disclosed embodiment is produced in such a way as to deploy quickly and be unlikely to be found to be defective following an explosion.

According to FIG. 1, the curtain 1 is placed in a box 2 itself placed on the external face of a lintel of the opening 110 that is to be recontained.

The device arranged on the outside of the building that is to be recontained is thus protected by the lintel from blast projectiles originating from an explosion.

The material of the curtain is chosen according to the chemical resistance performance required but is typically made up of a woven fabric coated on both sides with one or more layers of one or more sealing materials, the fabric also being equipped with horizontal stiffeners distributed over the entire height of the curtain.

The curtain storage box is made up of a plurality of juxtaposed modules 2*a*, 2*b*, 2*c*, 2*d*, the plurality of modules comprising modules 2*b* referred to as active modules which are provided with curtain retaining and release means which will be detailed further on, and modules referred to as passive modules 2*a*, 2*c*, 2*d* which do not have said means for retaining and releasing the curtain 1.

In the event of an explosion, the fact that the box is made in the form of modules sized to withstand explosions allows the box to deform if the lintel deforms.

Sealing foils 201 are arranged in the gaps between the modules and flashing 202 is positioned on the wall and covers the fixings 111, 11*a* that fix the modules to the wall.

For a door measuring 4 m wide and a door height of 4 m, assuming that the curtain overhangs the fixed frame by 50 cm on each side, a box in the form of a parallelepiped measuring approximately 0.8×0.6×5 m is required.

The appropriate number of modules for this length is selected in the knowledge that use is made of two end modules 2*a* and two active modules 2*b* and as many additional passive modules 2*c* as required being positioned between the active modules.

The time taken for the curtain to fall into place that it is desirable to achieve can be estimated at under one second because curtain deployment corresponds approximately to a freefall from a height of 4 m.

This is a free fall and no guide is produced on the sides of the opening as such guides would do nothing but slow the fall of the curtain or even block it in the event of deformation following the explosion.

Figure 2:
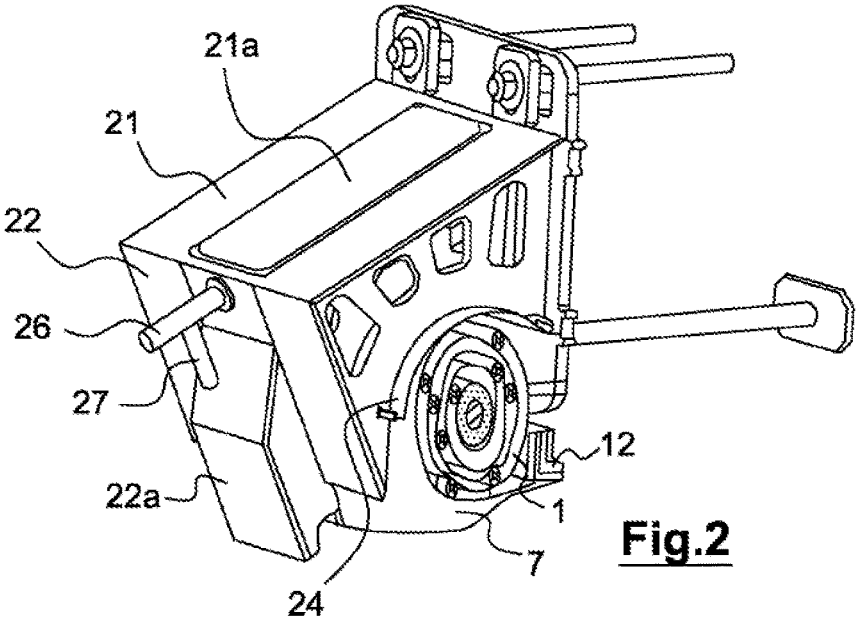
FIG. 2 is a perspective view of an active module according to the disclosed embodiment.

An example of an active module is shown in perspective in FIG. 2.

Such a module, like the passive modules, comprises an upper wall 21, a front wall 22, and lateral walls 23, the lateral walls 23 having rounded cutouts to accept curtain centering plates 24.

In addition to comprising the passive modules it also comprises a hatch 21*a* providing access to the curtain retaining and release means, a hood 22*a* under which the curtain retaining means is positioned and a device for enabling/disabling the curtain retaining and release means.

Figure 3:
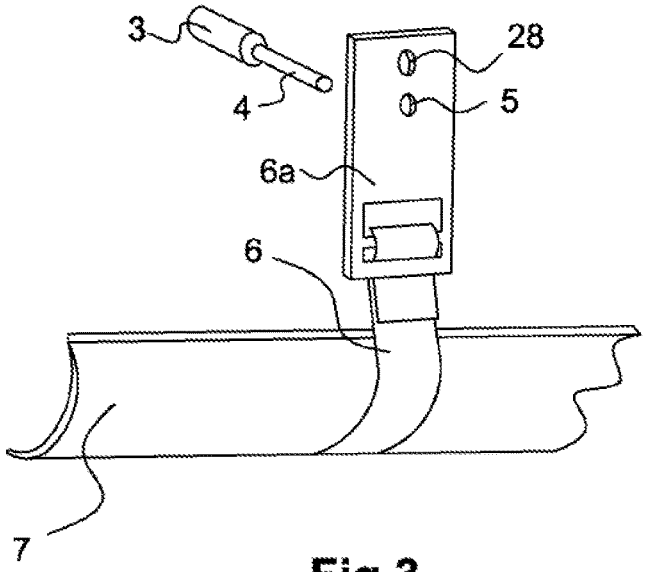
FIG. 3 is a detail, viewed in perspective, of a curtain retaining means according to one aspect of the disclosed embodiment.

Still according to FIG. 2, the curtain 1 is wound on itself and retained by in a flexible or fabric storage wrapper 7 made from the same material as the curtain, suspended on the lintel side from fixing bars 12 on which the rolled curtain rests and suspended on the opposite side to the lintel by fingers 4, for example the rods of the retractable actuating cylinders 3 of the active modules 2*b* as depicted in FIG. 3.

In the example depicted in FIG. 3, the fabric 7 is secured to two reinforcing straps 6 each ending in a metal buckle 6*a* provided with holes or eyelets 5, 28.

When the curtain is in the retained position, the fingers 4 of the actuating cylinders 3 are inserted in the eyelets 5.

Figure 5:
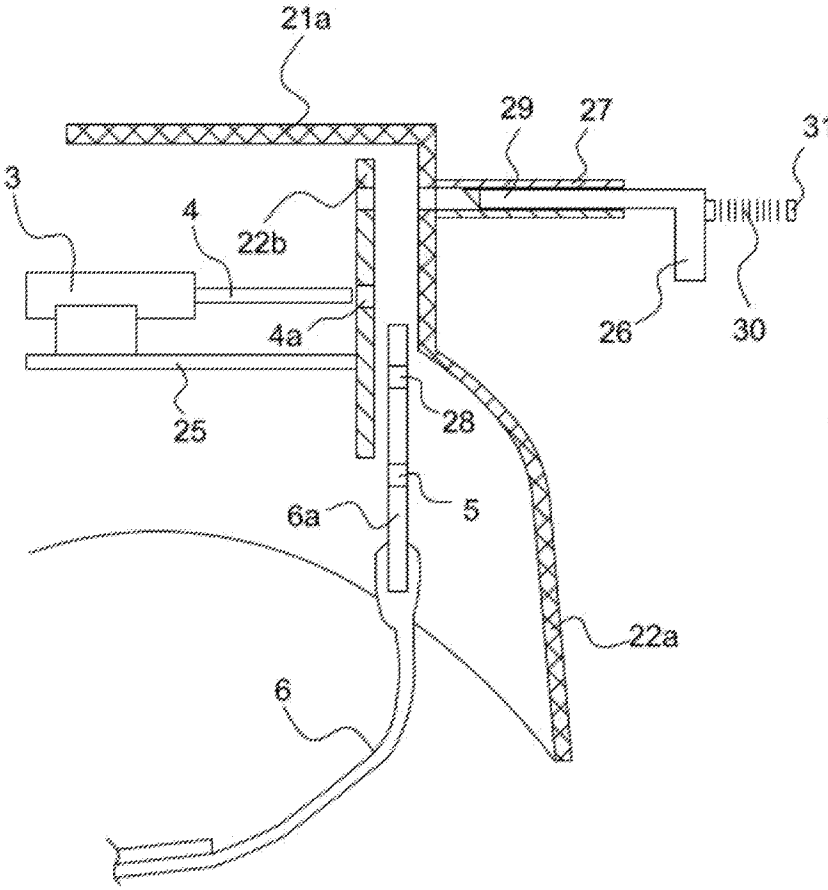
FIG. 5 is a partial side view in cross section of the module of FIG. 2.

The actuating cylinders and the buckles of the straps are housed in the active modules as depicted in FIG. 5 which is a partial view in cross section of an active module which comprises, under the hatch 21*a*, a mounting plate 25 to which the actuating cylinder 3 is fixed, and a front plate 22*b*, behind the hood 22*a*, provided with a hole 4*a* for the passage of the finger 4 of the actuating cylinder 3.

The front plate 22*b* and the hood 22*a* are spaced apart in order to create a housing or slot that allows the introduction of a buckle 6*a* of a curtain retaining strap 6 and creates a housing for this buckle.

To allow easy installation of the curtain, provision is made for at least one of the active modules to be equipped with a handle 26 for disabling the curtain release means.

This handle comprises a lock bolt 29 which slides in a tube 27 fixed at right angles to the hood 22*a* which is pierced to allow the lock bolt 29 to pass.

The lock bolt may, according to the position of the handle, slide or be prevented from sliding in the tube 27 so as to become inserted in the eyelet 28 of the buckle 6 housed in the housing delimited by the hood 22*a* and the plate 22*b*.

Figure 4:
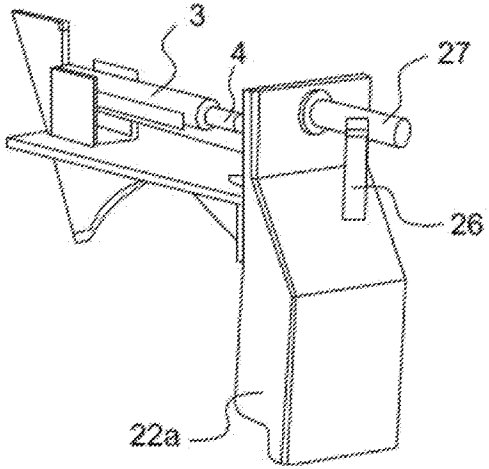
FIG. 4 is a perspective view of a detail of the module of FIG. 2.

FIG. 4 shows the enabling and disabling handle, the axis of the lock bolt of which lies above the axis of the finger 4 of the actuating cylinder 3.

The operation of the disabling device is described in FIGS. 6A to 6D. Disabling means a position blocking the curtain in the wound position preventing it from falling.

First of all, the locking bolt 29 is able to engage, in at least a disabling position, in the second eyelets 28 of the straps so as to retain the curtain whatever the position of the fingers 4 of the actuating cylinders 3.

A return spring 30 pushes the handle in the direction of introduction of the tip of the locking bolt into the receiving space in the buckle 6*a*.

The operation of the handle is intended to achieve three positions.

Figure 6A:
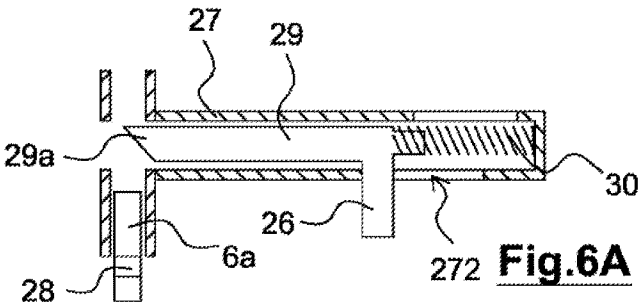
FIGS. 6A to 6C are views in cross section of a disabling means according to one aspect of the disclosed embodiment.

A first position corresponding to FIG. 6A allows the curtain to be placed in a mounting position. In this position, the cut corner 29*a* of the locking bolt 29 can move aside as the buckle 6*a* passes until the locking bolt has become inserted in the hole or eyelet 28 in the buckle thereby allowing the curtain to be held as the finger or rod of the actuating cylinder deploys. The locking bolt is then retracted.

Figure 6B:
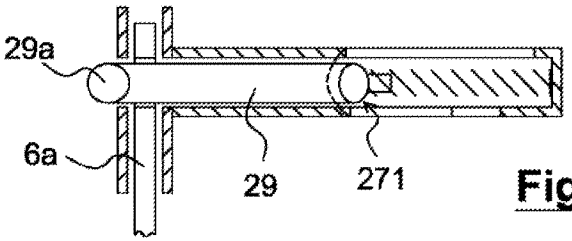

A second position corresponding to the position of FIG. 6B is a safety position blocking the system, the disabling position. In this position, the locking bolt driven into the hole 28 of the buckle 6*a* cannot retract and the curtain is restrained whatever the position of the fingers.

Figure 6C:
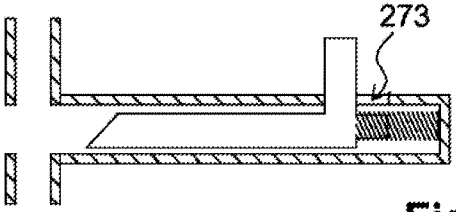
Figure 6D:
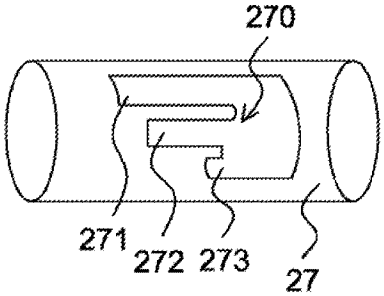
FIG. 6D is a side view of part of a tube that accepts the disabling means.

A third position corresponding to the position of FIG. 6C is the operating position of the system, the locking bolt is retracted which means that curtain retention and release are dependent on the position of the fingers and, in the case described, of the rods of the actuating cylinders.

The three positions are allowed by the fact that three grooves 271, 272, 273 of increasing length are made in the tube 27 that houses the locking bolt, the handle being pulled towards the rear against the action of the spring 30 and then turned in order to switch from one of these positions to another.

To sum up then, the grooves 271, 272, 273 thus define three positions for the handle, a curtain installation position, a curtain blocking position and a curtain release position.

The grab stalk of the handle is designed and arranged in such a way as to alert the operator to the above-described positions of the device and for this purpose constitutes a visual marker.

Figure 7A:
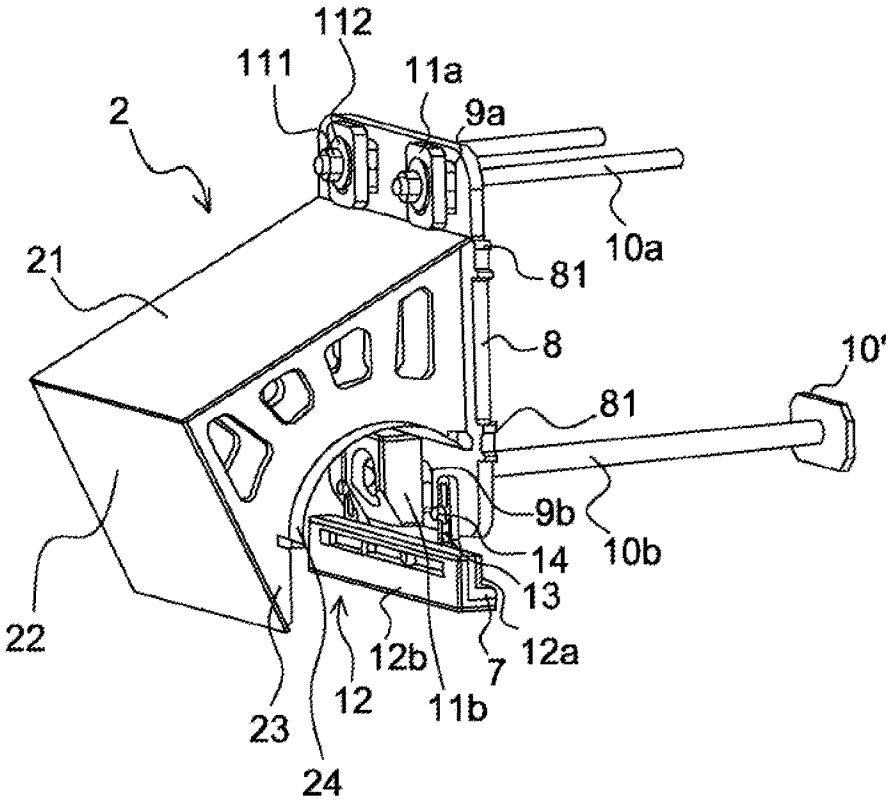
FIG. 7A is a perspective view of a module of the disclosed embodiment and of the means of fixing it to a lintel.

FIG. 7A depicts the means for fixing a module to the lintel of the opening.

The module depicted here is a passive module but the fixing is the same for the active modules.

Rods 10*a*, 10*b* which are threaded at the ends are fixed in the wall either cemented in like the rods 10*a* or passing through and stopped by a head 10' like the rod 10*b*.

The modules comprise a rear face 8 provided with holes 9*a*, 9*b* to accept the rods 10*a*, 10*b* with a positioning clearance that allows the modules 2 to be correctly positioned next to one another.

Shims such as blocks or washers 11*a*, pierced with a hole to accept the rods are positioned in such a way as to press the rear face against the lintel and fixing means such as nuts 111 and washers 112 grip the shims which hold the rear face of the modules.

Figure 7B:
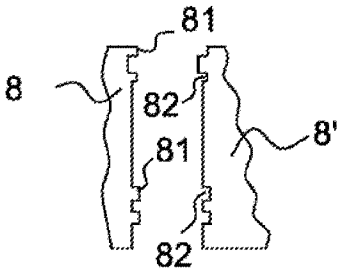
FIG. 7B is a detail of the rear plates of the modules.

In FIG. 7B, in order to position the modules in relation to one another, the modules on the lateral edges of their rear faces 8, 8' comprise a male-female positioning device which, according to the example, comprises pins 81 on one side and pin-receiving cutouts 82 on the other.

A shim 11*b*, which lies in the curtain accommodating space, is advantageously a rounded solid shim possibly made of an elastic material such as an elastomer so as to avoid damaging or trapping the curtain.

In order to fix the web 7, the fixing bars 12 are fixed to the rear face of the modules by fixing means 13, 14 that have a range of adjustment of position in the vertical direction of deployment of the curtain.

This allows the fixing bars of all the modules to be aligned.

The fixing bars as depicted are bars comprising two L-shaped branches 12*a*, 12*b* to grip the web 7.

The bars 12 are L-shaped and this allows the curtain to be pressed firmly against the concrete of the lintel in order to guarantee that the curtain seals. The length of the horizontal part of the L is obtained by combining dimensions, for example consistent with the thicknesses of the parts 8 and 12*a*.

On the sides of the component 8, devices such as spikes/cutouts of male/female type may allow the modules 2 to be aligned with one another.

The retractable actuating cylinders are, for example, activated by an electric signal from an explosion detection sequence. This explosion detection sequence may be of the type described in U.S. Pat. No. 6,031,462 A.

Use is preferably made of electric actuating cylinders but it is also possible to use pyrotechnic actuators or electromagnetic latches in order to retain/release the curtain.

The modules are mechanically sized to withstand the shockwave caused by the explosion and, during mounting, the gaps between the adjacent modules are covered with bonded foil in order to improve the overall sealing of the box.

The wall fixings are protected by a covering hood known as flashing.

The device is designed to remain operational after a very lengthy period of non-use under natural or manmade inclement weather conditions.

The choice of electric actuating cylinders is crucial from this standpoint as the actuating cylinders need to have excellent reliability after a lengthy period of storage, and for example a choice will be made to use actuating cylinders for smoke extraction panels.

Moreover, the actuating cylinder control system comprises a synchronization device on its electrical part, so as to ensure that all the active modules release the curtain simultaneously, so as to prevent the latter from dropping crooked and failing to reach the floor.

What is claimed is:

1. A containment device comprising a curtain that can be deployed from a wound or folded first position into an unwound or unfolded second position, comprising a storage box for storing the curtain in the first position, wherein the box is made up of a plurality of juxtaposed modules, the plurality of modules comprising active modules which are provided with means for retaining and releasing the curtain and passive modules which do not have said means for retaining and releasing the curtain.

2. The containment device as claimed in claim 1, wherein the means for retaining and releasing the curtain are actuating cylinders.

3. The containment device as claimed in claim 2, wherein each actuating cylinder of the actuating cylinders comprises a finger able to move between a deployed curtain-retaining position and a retracted curtain-release position.

4. The containment device as claimed in claim 3, wherein the finger of each actuating cylinder is inserted in the deployed position into a first eyelet of an associated curtain retaining strap, the fingers, of the actuating cylinders, in the retracted position releasing the curtain retaining strap so as to allow the curtain to fall.

5. The containment device as claimed in claim 4, comprising a curtain retaining web connected to the straps and on which the curtain rests in the wound position.

6. The containment device as claimed in claim 4, wherein the ends of the straps that accept the fingers of the actuating cylinders are provided with rigid plates in which the first eyelets are made.

7. The containment device as claimed in claim 1, wherein each module of the plurality of modules comprises a rear face for attaching the module to a wall, which rear face is provided with holes for accepting rods projecting from the wall, said holes being sized to allow the modules some clearance with respect to the diameter of the rods.

8. The containment device as claimed in claim 7, wherein the fixing of the module to the rods involves shims to compensate for the clearances for fitting the rear face to the wall.

9. The containment device as claimed in claim 8, wherein at least one of said shims is arranged in the lower part of the module in a space accommodating the curtain, which is rounded in shape and not likely to damage the curtain.

10. The containment device as claimed in claim 7, comprising bars for supporting a top end of the curtain, said bars being fixed to the rear face of each module of the plurality of modules by fixing means which are provided with a range of position adjustment in the vertical direction of deployment of the curtain.

11. The containment device as claimed in claim 1, wherein the each module of the plurality of modules comprises an upper wall, a front wall and lateral walls, the lateral walls comprising rounded cutouts provided with curtain centering plates which press on or cover the external diameter of the rolled curtain.

12. The containment device as claimed in claim 1, wherein the active modules comprise at least one means for disabling the means for retaining and releasing the curtain.

13. The containment device as claimed in claim 4, wherein the active modules comprise at least one means for disabling the means for retaining and releasing the curtain and wherein the means for disabling comprises a handle equipped with a locking bolt which, in a disabling position at least, engages in second eyelets of the straps retaining the curtain whatever the position of the fingers of the actuating cylinders.

14. The containment device as claimed in claim 13, wherein the handle is received in a tube provided with grooves defining three positions of the handle, a curtain installation position, a curtain immobilizing position and a curtain release position, the handle being able to signal these positions to the operator.

* * * * *